US005610506A

United States Patent [19]

McIntyre

[11] Patent Number: 5,610,506

[45] Date of Patent: Mar. 11, 1997

[54] VOLTAGE REFERENCE CIRCUIT

[75] Inventor: David H. McIntyre, Bristol, United Kingdom

[73] Assignee: SGS-Thomson Microelectronics Limited

[21] Appl. No.: 559,034

[22] Filed: Nov. 15, 1995

[30] Foreign Application Priority Data

Nov. 15, 1994 [GB] United Kingdom ..... 9423033

[51] Int. Cl.[6] ..... G05F 3/16

[52] U.S. Cl. ..... 323/313; 365/226

[58] Field of Search ..... 323/312, 313, 323/314, 315; 365/189.09, 226, 227

[56] References Cited

U.S. PATENT DOCUMENTS

| | | | |
|---|---|---|---|
| 4,612,632 | 9/1986 | Olson | 365/226 |
| 4,658,156 | 4/1987 | Hashimoto | 307/350 |
| 4,849,656 | 7/1989 | Neidorff | 327/78 |
| 4,857,823 | 8/1989 | Bitting | 323/314 |
| 4,935,645 | 6/1990 | Lee | 327/88 |
| 4,975,883 | 12/1990 | Baker et al. | 365/226 |
| 5,177,707 | 1/1993 | Edme | 365/203 |
| 5,349,286 | 9/1994 | Marshall et al. | 323/315 |

FOREIGN PATENT DOCUMENTS

| | | | |
|---|---|---|---|
| 0473138 | 3/1992 | European Pat. Off. | G05F 3/24 |
| 0594294 | 4/1994 | European Pat. Off. | G11C 16/06 |

*Primary Examiner*—Matthew V. Nguyen

*Attorney, Agent, or Firm*—David M. Driscoll; James H. Morris

[57] ABSTRACT

A reference circuit is provided which generates a reference voltage which is always at least as high as a stable reference value. This is done by generating a lock signal which is maintained at a first logic level during start-up of the reference circuit and then attains a second logic level when the reference value has stabilized. The reference circuit can be a bandgap reference circuit.

11 Claims, 3 Drawing Sheets

VOLTAGE REFERENCE CIRCUIT

FIELD OF THE INVENTION

This invention relates to a voltage reference circuit.

BACKGROUND TO THE INVENTION

The invention is particularly but not exclusively concerned with a reference circuit for use in a voltage detection circuit for detecting the power supply for flash EPROM chips. A voltage detection circuit is needed for these chips to prevent programming or erasing of the flash memory when the normal power supply voltage Vcc is below a safe value (normally referred to as VLKO in the data sheet). This is because when the power supply voltage is below a certain value, the memory chip may not operate reliably, which could cause programming and/or erasing of random memory cells.

Flash memory chips also require a high voltage power supply Vpp of about 12 V for programming the memory, and it can be desirable to provide a detection circuit for that voltage as well.

For flash memory chips capable of operating with the power supply voltage at either 3.3 V or 5 V, it is also desirable for the voltage detection circuit to determine the power supply voltage range.

A known voltage detection circuit is shown in FIG. 1. This circuit includes a comparator 2 having a minus input 4 to which is supplied a voltage V1 derived from the power supply voltage Vcc through a resistive chain comprising resistors R1 and R2. The comparator 2 also has a plus input 6 which receives a voltage reference VREF. The comparator is operable to change the logic state of its output signal VDETECT depending on whether or not V1 exceeds VREF. If V1 is greater than VREF, VDETECT remains low. However, if V1 is less than VREF, VDETECT goes high, indicating that the power supply voltage Vcc has not yet reached its correct value.

The reference voltage and the ratio between resistors $R_1$, $R_2$ are set at a suitable value for comparison depending on the desired level of the power supply voltage.

A similar detection circuit can be used to detect if the operating power supply range is 3.3 V plus or minus 0.3 V or 5 V plus or minus 0.5 V. To do this, the voltage detection circuit must generate an output signal VDETECT which switches between 3.6 V and 4.5 V. In this case, the output signal VDETECT is used to reconfigure parts of the internal circuitry of a flash memory chip depending on the power supply range.

In FIG. 1, the voltage V1 derived from the power supply voltage is essentially independent of temperature or process variations, because it is obtained from a resistor divider. However, any variation in the reference voltage VREF will produce an unwanted variation in the voltage detection level. It is therefore one object of the invention to select a good reference source for the voltage reference VREF.

In addition, the reference voltage VREF is required to operate reliably during power transitions, otherwise the voltage detection circuit may fail to operate properly just when it is needed most. It is another object of the present invention to provide a voltage detection circuit which operates reliably during power transitions.

SUMMARY OF THE INVENTION

The present invention resides in one aspect in using a bandgap reference circuit to generate the reference voltage for a voltage detection circuit. As is well known in the art, a bandgap reference circuit includes an operational amplifier having a plus input and a minus input. An output signal of the operational amplifier is supplied to the gate of a p-channel output transistor which has its source connected to an upper power supply voltage rail and its drain connected to supply a feedback current to first and second resistive chains. The first resistive chain includes a first resistor and a second resistor connected in series with a first diode-connected bipolar transistor. The second resistive chain comprises a single resistor connected in series with a second diode-connected bipolar transistor. The plus input of the operational amplifier receives its input from a node intermediate the first and second resistors of the first resistive chain. The minus input of the operational amplifier receives its input from a node intermediate the resistor of the second resistive chain and the emitter of the second bipolar transistor. The collectors of the bipolar transistors are connected to the lower supply rail, which will normally be at ground. The reference voltage generated by the bandgap circuit is derived from the reference level at an output node at the junction of the first and second resistive chains.

Operation of the bandgap reference circuit is well known to a person skilled in the art and is therefore only discussed briefly herein. The first bipolar transistor is designed to have an emitter area which is several times larger than the emitter area of the second bipolar transistor. The base emitter voltage Vbe across the bipolar transistors varies linearly between 0.8 V and 0.4 V when the temperature varies from minus 55° C. to 150° C. As the emitter area of the first bipolar transistor is larger than the emitter area of the second bipolar transistor but the current through it is the same, the first bipolar transistor has a lower base emitter voltage across it. The resistors of the first and second resistive chains, together with the operational amplifier, amplify this voltage difference by a suitable voltage and add it to the original base emitter voltage to produce a constant output reference voltage $V_{BG}$. This is a very good reference because it does not depend on temperature or on the power supply voltage.

However, depending on the conditions of use of the bandgap reference circuit, it can take several microseconds for the reference voltage generated by the bandgap reference circuit to settle at its final value. During this start-up period, if the reference voltage $V_{BG}$ is above its correct value, then the chip will be safe because the power supply voltage would need to be at a higher than normal level to be detected as adequate. Thus, the power supply voltage level would not be indicated as adequate below a safe value. However, if during start-up the reference voltage generated by the bandgap reference circuit is below its correct level, then a much lower than normal level of the power supply voltage could be detected as adequate by the voltage detection circuit. Thus, the output signal VDETECT from the voltage detection circuit could fail to change state to indicate an inadequate power supply voltage, causing a risk of data corruption in the chip.

It is thus an object of the present invention to provide a reference circuit which generates a reference voltage which is always at least as high as a stable reference value. Such a circuit is useful not only in a voltage detection circuit as outlined above, but in any situation where it is desirable to ensure that the reference voltage is at least as high as a stable value.

According to one aspect of the present invention there is provided a reference circuit arranged to generate at a reference node a reference voltage which changes during start-up from a power down value to a stable reference value and including: a lock signal generating circuit for generating a lock signal which is maintained at a first logic level during start-up of the reference circuit and then attains a second logic level when the reference value has stabilized; and a lock transistor having a controllable node connected to receive said lock signal and a controllable path connected between a start-up voltage level and said reference node, said start-up voltage level being at least as high as said stable reference value whereby the reference voltage is held at said start-up voltage level during start-up of the circuit.

The start-up voltage level can conveniently be derived from a power supply voltage for the reference circuit, since the power supply voltage will always be higher than the stable reference value of the reference voltage generated by the circuit.

The lock signal generating circuit can include start-up circuitry for generating a start-up signal at said first logic level during start-up and a lock generator comprising first and second inverters, the first inverter being coupled to receive said start-up signal and the second inverter being arranged to generate said lock signal.

This arrangement has the advantage that the lock signal generated by the lock generator turns on the lock transistor harder and faster than using the start-up signal itself. Thus, the lock transistor is activated to hold the reference voltage at the start-up voltage level at a very short time after the reference circuit has been turned on.

Preferably, the first inverter is skewed to have a high trip point so that the start-up signal does not have to go fully low to activate the lock generator.

The lock transistor can be a p-channel MOSFET device with its gate connected to receive the lock signal, its source connected to the start-up voltage level and its drain connected to the reference node.

When a power supply voltage is applied to the reference circuit to turn it on there is an initial phase during which the power supply ramps up where the voltage at the reference node is unpredictable. Voltage ramps also occur after a change in state of a power down signal rendering the voltage at the reference node unpredictable. The voltage at the reference node then rises slowly from some intermediate value to its correct stable value. During this start-up phase, when the start-up signal is low, the lock signal is generated so that it is also low and clamps the reference node to the start-up voltage level. This ensures that the reference voltage cannot be lower than the start-up voltage level. Where the start-up voltage level is taken from the power supply to the reference circuit, which is above the stable reference value, this means that the reference voltage will drop down from the start-up voltage level to its stable value, rather than rising from a lower value up to the stable value.

This is particularly useful in a voltage detection circuit which comprises a comparator for receiving at one input an input voltage derived from a voltage to be detected and at another input a reference voltage derived from a reference circuit according to the invention. The reference circuit of the present invention ensures that the reference voltage will always be at least as high as the stable reference value and therefore ensures that a lower than normal level of the voltage to be detected would not be detected as adequate. This is particularly useful where the voltage detection circuit is used to detect a power supply voltage for a flash memory chip.

For a better understanding of the present invention and to show how the same may be carried into effect reference will now be made by way of example to the accompanying drawings.

DESCRIPTION OF THE PREFERRED EMBODIMENTS

Figure 1:
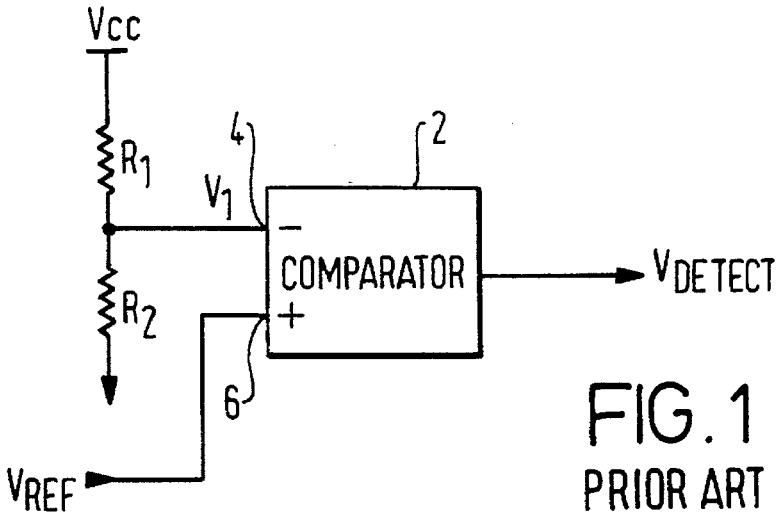
FIG. 1 PRIOR ART
FIG. 1 is a diagram showing a voltage detection circuit according to the prior art.
Figure 2:
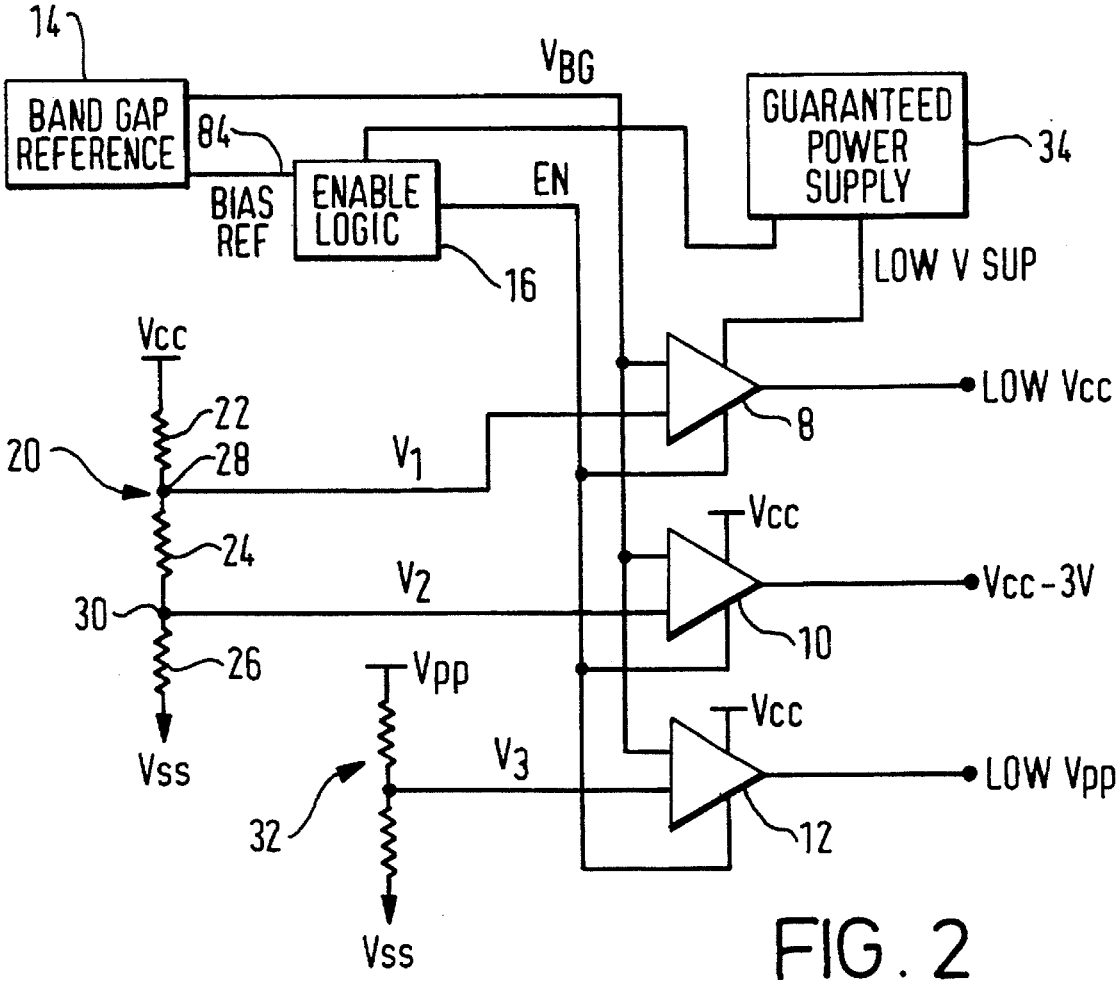
FIG. 2 is a block diagram of a detection circuit according to one embodiment of the present invention.

FIG. 2 shows a voltage detection circuit which is capable of detecting three different power supply levels. The voltage detection circuit includes first, second and third comparators 8, 10, 12. Each comparator receives a reference voltage $V_{BG}$ derived from a bandgap comparator reference circuit 14. Each of the comparators 8, 10 and 12 also receive an enable signal EN from enable logic 16. The generation and use of this enable signal forms the subject of our copending Application No. 08/559,490, Nov. 15, 1995, the contents of which are herein incorporated by reference. Briefly, the enable signal EN is generated to disable the comparators 8, 10 and 12 during an initialise phase of the circuit. The first comparator 8 is arranged to provide an output signal LOW Vcc which detects when the power supply voltage has fallen below an adequate level. To achieve this it compares its reference voltage $V_{BG}$ with a voltage V1 which is derived from the power supply voltage Vcc via a resistive chain 20 connected to a lower power supply rail Vss normally at ground. The resistive chain 20 comprises three resistors 22, 24, 26 and the voltage V1 is taken from a node 28 between the resistors 22 and 24.

The second comparator 10 provides an output signal Vcc3 V which indicates the power supply operational range for the chip (i.e. 3 V±0.3 V or 5 V±0.5 V). To do this, the second comparator 10 receives an input voltage V2 from a second node 30 between resistors 24 and 26 in the resistive chain 20.

The third comparator 12 provides a signal LOW Vpp indicating failure of a second voltage supply Vpp, which is the voltage supply used for some operations of the chip and which is generally at a voltage higher than Vcc, and typically at 12 V. To do this, the third comparator 12 has an input signal V3 derived from a resistive chain 32 connected between the second power supply voltage Vpp and Vss.

It will readily be appreciated that the present invention is applicable to the generation of any one or more of the output signals illustrated in FIG. 2 and is thus not restricted to the case where all three comparators are present.

The first comparator is supplied with a guaranteed power supply 34 which always maintains at least a minimum voltage denoted as the signal LOWV SUP in FIG. 2. The second and third comparators 10, 12 each receive a power supply Vcc.

Figure 3:
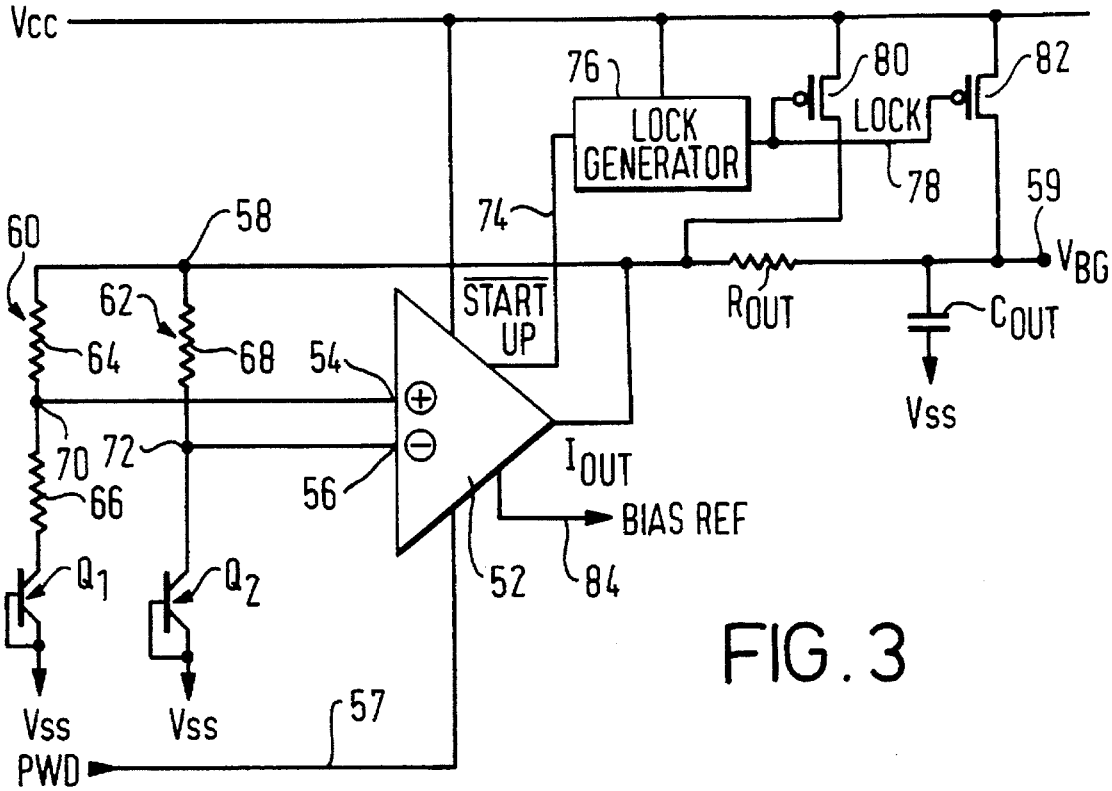
FIG. 3 is a circuit diagram illustrating a bandgap reference circuit with a lock generating circuit.

FIG. 3 illustrates a circuit diagram of the bandgap reference circuit 14. The bandgap circuit 14 includes an operational amplifier 52 having a plus input 54 and a minus input 56. An output signal Iout of the operational amplifier 52 is supplied to a junction node 58 of first and second resistive chains 60, 62. The first resistive chain 60 includes a first resistor 64, a second resistor 66 and a first diode-connected bipolar transistor Q1. The second resistive chain 62 includes a first resistor 68 and a second diode-connected bipolar transistor Q2. The plus input 54 of the operational amplifier 52 receives its input from a node 70 intermediate the first and second resistors 64, 66 of the first resistive chain 60. The minus input 56 of the operational amplifier 52 receives its input from a node 72 intermediate the resistor 62 and the second bipolar transistor Q2 of the second resistive chain 62. The collectors of the bipolar transistors are connected to the lower voltage supply rail Vss, normally at ground. The operational amplifier receives the power supply voltage Vcc and can be powered down by a power down signal PWD on line 57. Operation of the bandgap circuit is well known to a person skilled in the art and has already been outlined in the introductory part of this text. Because of the feedback, the feedback signal Iout attains a stable reference level which is independent of temperature and operating conditions. The reference voltage $V_{BG}$ output at a reference node 59 from the bandgap reference circuit 14 is derived from the level at the junction node 58 via a filter comprising a resistor Rout and a capacitor Cout.

The operational amplifier 52 also contains circuitry to generate a start-up signal STARTUP and a bias ref signal BIAS REF. The start-up signal on line 74 is fed to a lock generator circuit 76. The lock generator circuit 76 receives its power supply from the upper power supply rail Vcc and generates a lock signal on line 78. The lock signal is fed to the gate of a first p-channel MOSFET 80 which is connected between the power supply voltage Vcc and the junction node 58 and also to a second p-channel MOSFET 82 which is connected between the power supply voltage Vcc and the reference node 59.

The signal BIAS REF on line 84 is supplied to the enable logic 16.

Figure 4:
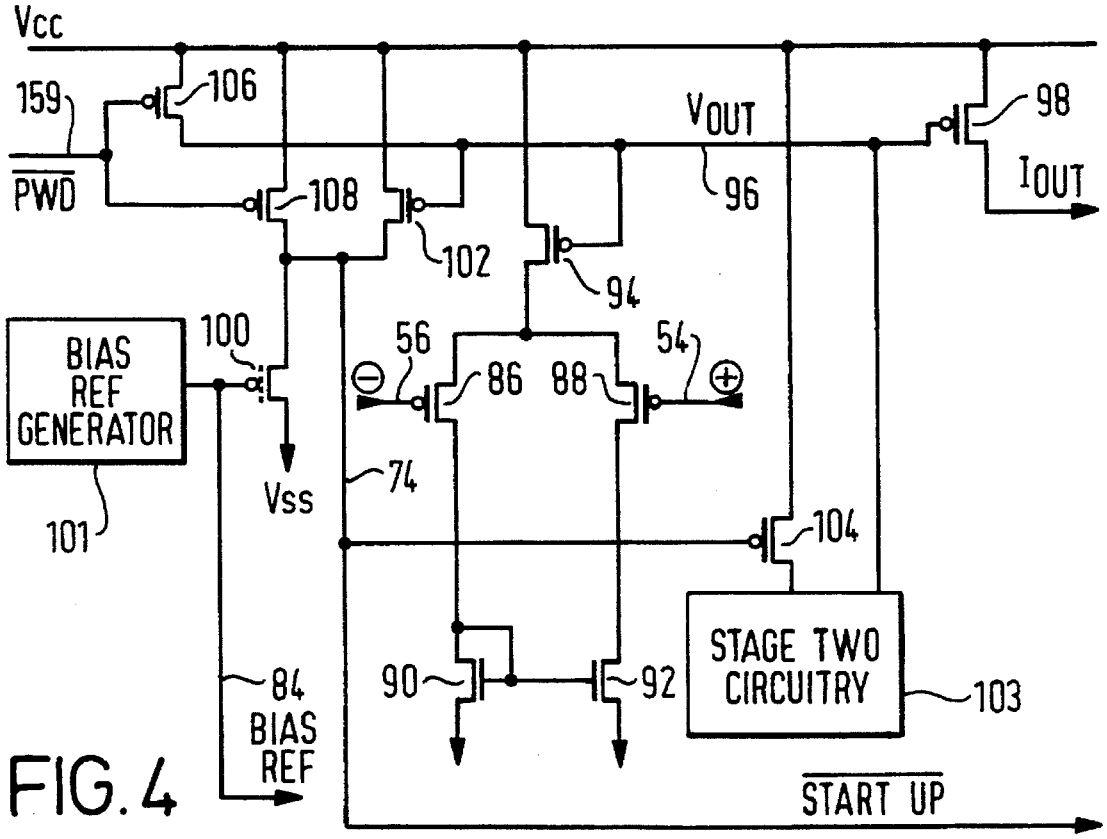
FIG. 4 is a transistor level diagram of a bandgap reference circuit with a start-up signal generating circuit.

FIG. 4 is a transistor level diagram of the operational amplifier 52. This comprises a known amplifier circuit in which stage one circuitry includes a long-tailed pair comprising source-connected p-channel transistors 86, 88. Transistor 88 acts as the plus input 54 while transistor 86 acts as the minus input 56. The drains of the transistors 86,88 of the long-tailed pair are connected to respective current mirror transistors 90, 92. The sources of the transistors 86, 88 are connected in common to a p-channel transistor 94 which has its source connected to the power supply rail Vcc and its gate connected to an output line 96 of the amplifier circuit. The amplifier circuit includes stage two circuitry 103 which does not form part of the invention and is not discussed herein. The signal Vout on the output line 96 is supplied to the gate of a p-channel output transistor 98 which has its source connected to the power supply voltage Vcc and its drain connected to supply the feedback current.

The operational amplifier also includes start-up circuitry which is constituted by a bias reference generator circuit 101, a resist transistor 100, a bias transistor 102 and a start-up transistor 104. First and second power down control transistors 106, 108 responsive to a control signal PWD on line 159 derived from the power-down signal PWD on line 57 are connected between the upper power supply rail Vcc and respectively the output line 96 and the resist transistor 100. Both the control transistors 106, 108 receive the signal PWD at their gates.

The bias reference generator circuit 101 generates the signal BIAS REF on line 84 which provides the gate voltage for the resist transistor 100. The signal BIAS REF could be replaced by the power supply voltage Vcc but the circuit would not operate so well over a large range of power supply voltages.

The bias transistor 102 has its source connected to the power supply voltage Vcc and its gate connected to the output line 96 of the amplifier circuit. Its drain is connected in common with the drain of the second control transistor 108 to the start-up signal output line 74. The start-up transistor 104 has its gate connected to receive the start-up signal on line 74, its source connected to the power supply voltage Vcc and its drain connected to the stage two circuitry 103.

In normal operation, the bias transistor 102 acts as a current source and attempts to supply more current than the resist transistor 100 can sink, thereby maintaining the start-up signal on line 74 at a high level. However, during start-up the signal Vout on the output of the amplifier circuit 96 is high, so that the current through the p-channel transistors is essentially zero. Thus, the resist transistor 100 is able to pull the start-up signal on line 74 low. This in turn causes the start-up transistor 104 to be turned on, which pulls the stage two circuitry 103 high. This causes the signal Vout to go low which forces current through the p-channel transistors including the bias transistor. It also generates the feedback current Iout which is fed back through the resistive chains 60, 62 to the plus and minus inputs of the amplifier.

The start-up signal 74 remains low until the bias transistor 102 has been turned on sufficiently hard to overcome the current sinking effects of the resist transistor 100. It changes its state to a high level once the circuit has correctly started up. The design of the circuit is such that the reference voltage $V_{BG}$ is by then at a sufficiently high voltage to ensure correct operation.

Figure 5:
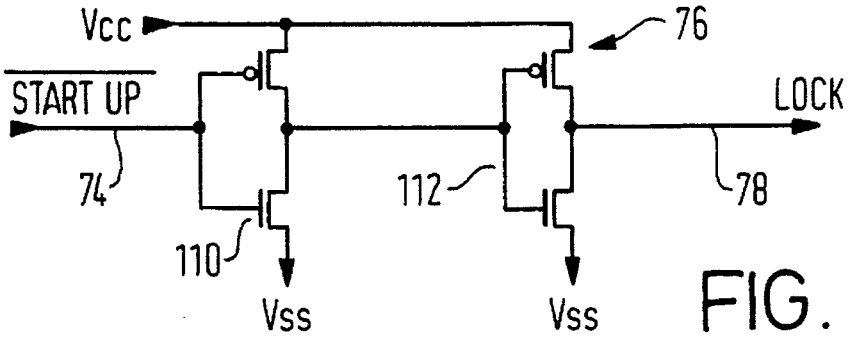
FIG. 5 is a transistor level diagram of a lock generating circuit.

FIG. 5 illustrates at transistor level the lock generator circuit 76. It comprises first and second inverters 110, 112. The first inverter receives the start-up signal on line 74 and supplies its output to the second inverter which supplies as its output the lock signal on line 78. The inverters are connected between the power supply voltages Vcc and Vss. It will readily be appreciated that the circuit of FIG. 5 operates to generate the lock signal from the start-up signal so that whenever the device is in start-up, i.e. the start-up signal is low, the lock signal also goes low. Referring back to FIG. 3 will illustrate that when the lock signal goes low, the p-channel transistors 80 and 82 clamp the reference level at junction node 58 and reference node 59 respectively to Vcc.

In FIG. 5, the first inverter 110 has a high trip point so that the start-up signal on line 74 does not have to go fully low to activate the circuit. This has the advantage that the lock transistors 80, 82 are turned on faster. However, non-skewed implementations are possible.

It will readily be appreciated that the start-up signal itself could be supplied directly to the p-channel transistors 80 and 82 to clamp the junction node 58 and reference node 59 to the power supply voltage Vcc during start-up. However, the provision of a separate lock generator circuit enables the lock transistors 80 and 82 to be turned on harder and faster than merely using the start-up signal itself.

It will be appreciated that while the junction node 58 rises from a power-down value to a stable reference value at a certain rate, the voltage at the reference node 59 will increase from a power-down value to a stable reference value at a slower rate, because of the effect of the RC time constant of the filter constituted by the resistor Rout and capacitor Cout. Therefore, although p-channel transistors 80 and 82 are illustrated in this circuit, it is to be noted that the most important effect of the invention is achieved by the p-channel transistor 82 which clamps the reference node 59 of the bandgap reference circuit during start-up. The p-channel transistor 80 is optional.

Figure 6:
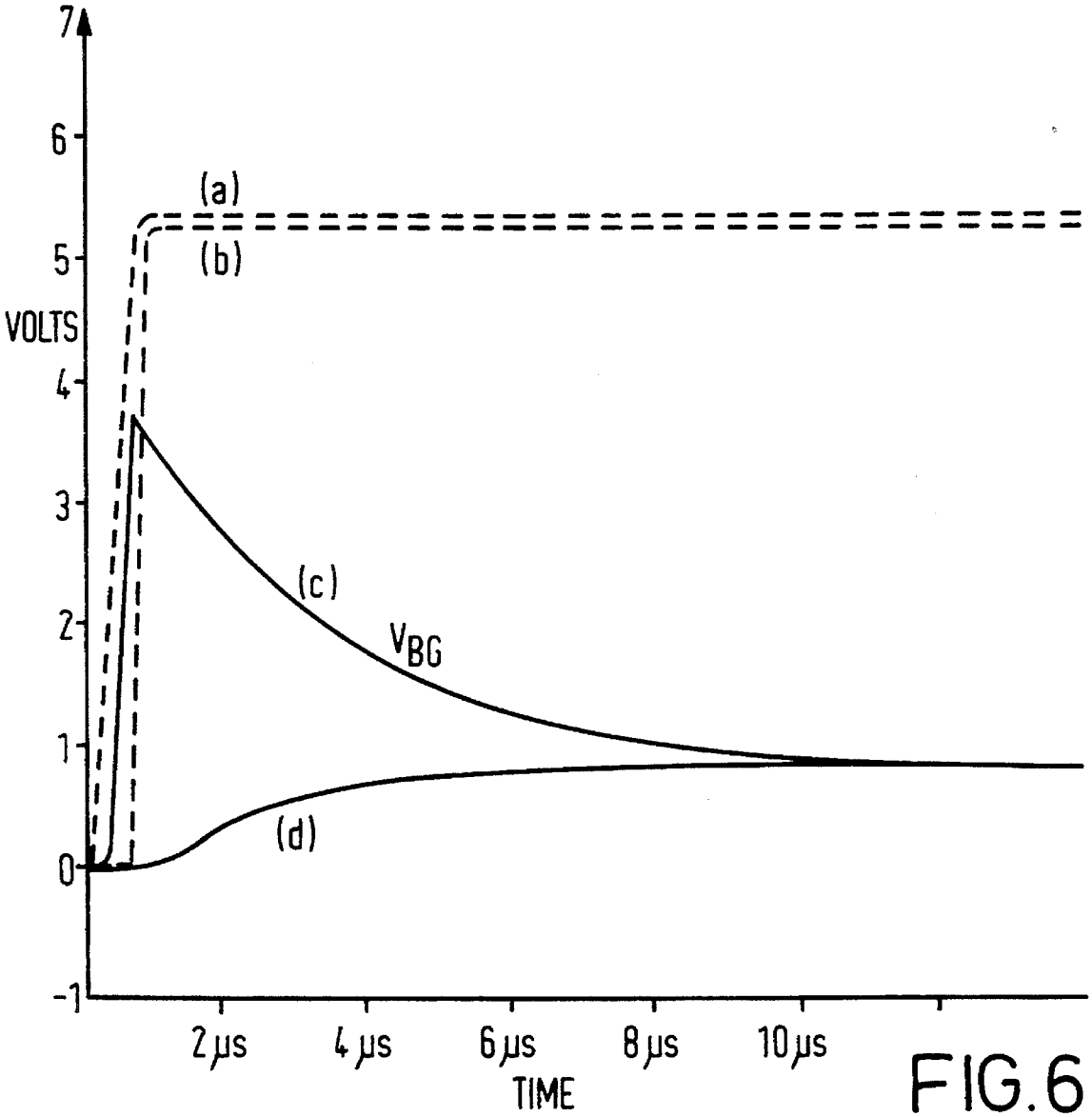
FIG. 6 is a graph of voltage against time.

The effect of the lock signal and lock transistor will now be described with reference to FIG. 6 which is a graph of voltage against time-for various signals. In FIG. 6, graph (a) denotes the power supply voltage Vcc. Graph (b) denotes the lock signal. Graph (c) denotes the reference voltage $V_{BG}$ and graph (d) denotes the voltage which would prevail at the reference node in the absence of the lock transistor.

Vcc ramps up during an initialise phase to a constant level which will normally be at just above 5 V. Graph (a) shows a fast ramp of lus to full Vcc. The lock signal (graph (b)) remains low until the power supply voltage Vcc has reached its constant level and then goes high. While the lock signal is low, the lock transistors 80 and 82 are turned on so the reference voltage $V_{BG}$ follows the power supply voltage. When the lock signal goes high (at about 1 μs), the p-channel lock transistors are turned off allowing the reference voltage $V_{BG}$ to settle to its stable value of about 1.25 V.

Graph (d) illustrates how the reference voltage might behave in the absence of the lock transistor. While the voltage supply Vcc is ramping up, there would be some fairly erratic and unpredictable behaviour which may result in the reference voltage rising from a low value to the stable reference level. As already explained, this is undesirable.

It will readily be appreciated that waveforms of the type illustrated in FIG. 6 can be a result either of application of the power supply potential between the power supply rails or by a change in state of the power-down signal, with Vcc remaining constant.

What is claimed is:

1. A reference circuit arranged to generate at a reference node a reference voltage which changes during start-up from a power down value to a stable reference value and including:

a lock signal generating circuit for generating a lock signal which is maintained at a first logic level during start-up of the reference circuit and then attains a second logic level; and a lock transistor having a controllable node connected to receive said lock signal and a controllable path connected between a start-up voltage level and said reference node, said start-up voltage level being at least as high as said stable reference value whereby the reference voltage is held at said start-up voltage level during start-up of the circuit when the lock signal is at the first logic level and attains the stable reference value when the lock signal is at the second logic level.

2. A reference circuit according to claim 1 wherein the lock transistor is a p-channel MOSFET transistor with its gate connected to receive the lock signal, its source connected to the start-up voltage level and its drain connected to the reference node.

3. A reference circuit according to claim 1 or 2 wherein the lock signal generating circuit includes start-up circuitry for generating a start-up signal at said first logic level during start-up and a lock generator comprising first and second inverters, the first inverter being coupled to receive said start-up signal and the second inverter arranged to generate said lock signal.

4. A reference circuit according to claim 3 wherein the first logic level is low and wherein the first inverter is skewed to have a high trip point so that the start-up signal does not have to go fully low to activate the lock generator.

5. A reference circuit according to claim 1 which is a bandgap comparator reference circuit arranged to generate said reference voltage derived from a feedback reference level at the reference node.

6. A voltage detection circuit comprising a reference circuit arranged to generate at a reference node a reference voltage which changes during start-up from a power-down value to a stable reference value and including:

a lock signal generating circuit for generating a lock signal which is maintained at a first logic level during start-up of the reference circuit and then attains a second logic level;

a lock transistor having a controllable node connected to receive said lock signal and a controllable path connected between a start-up voltage level and said reference node, said start-up voltage level being at least as high as said stable reference value whereby the reference voltage is held at said start-up voltage level during start-up of the circuit when the lock signal is at the first logic level and attains the stable reference value when the lock signal is at the second logic level; and a comparator for receiving at one input an input voltage derived from a voltage to be detected and at another input said reference voltage and operable to compare said input voltage with said reference voltage.

7. A voltage detection circuit according to claim 6 wherein said comparator derives its input voltage from a power supply voltage and is arranged to supply an output signal when the power supply voltage falls below an adequate level.

8. A voltage detection circuit according to claim 6 or 7 which comprises a second comparator operable to compare said reference voltage with a second input voltage different to said first-mentioned input voltage.

9. A voltage detection circuit according to claim 8 wherein the second input voltage is derived from a power supply voltage and is arranged to produce an output signal indicative of the range of voltages within which said power supply voltage falls.

10. A voltage detection circuit according to claim 6 which comprises a further comparator operable to compare said reference voltage with a further input voltage to generate a detection signal when said further input voltage falls below an adequate level.

11. A voltage detection circuit according to claim 10 wherein said further input voltage is derived from a second power supply voltage.

* * * * *